United States Patent [19]

Kuhn et al.

[11] Patent Number: 4,896,889

[45] Date of Patent: Jan. 30, 1990

[54] WORD GAME WITH BOARD AND PLAYING PIECES ROTATABLY SUPPORTED THEREIN

[76] Inventors: James O. Kuhn, 140 Nassau St., New York, N.Y. 10038; Michael W. Thompson, 1410 Girard NE., Albuquerque, N. Mex. 87106

[21] Appl. No.: 348,881

[22] Filed: May 8, 1989

[51] Int. Cl.[4] ..... A63F 3/00

[52] U.S. Cl. ..... 273/272; 273/150; 273/288

[58] Field of Search ..... 273/150, 272, 281, 288

[56] References Cited

U.S. PATENT DOCUMENTS

| | | | |
|---|---|---|---|
| 1,553,835 | 9/1925 | Peters | 273/272 |
| 3,170,696 | 2/1965 | Nielsen . | |
| 3,588,112 | 6/1971 | Holt . | |
| 3,797,829 | 3/1974 | Heller . | |
| 4,004,811 | 1/1977 | Brandin . | |
| 4,134,592 | 1/1979 | Pullman | 273/155 |
| 4,201,389 | 5/1980 | Vowell | 273/272 |
| 4,416,455 | 11/1983 | Munson et al. | 273/272 |
| 4,512,584 | 4/1985 | Propsom | 273/282 |

FOREIGN PATENT DOCUMENTS

| | | |
|---|---|---|
| 2508329 | 12/1982 | France . |
| 2116439 | 9/1983 | United Kingdom . |

*Primary Examiner*—Anton O. Oechsle

[57] ABSTRACT

A board game includes a playing board with a playing surface formed as a rectangular grid of multiple rows and columns of recesses. A multiplicity of playing pieces are dimensioned to seat within the recesses and have a body portion about the periphery of which are repetitions of an indicium, such as a letter of the alphabet, and each repetition is in a distinct color. In game play a first player may place a multiplicity of playing pieces in aligned recesses to construct a cognizable linear array of indicia such as a word, and each playing piece displays its indicium in a preselected color associated with that player. The second player may place at least one playing piece in an empty recess adjacent one of the recesses utilized by the linear array of the first player and thus create a new cognizable linear array incorporating the added indicium which is rotated to display the repetition of the indicium in a color associated with the second player. The second player also rotates the playing piece(s) of the first player incorporated in the new linear array to display the indicia thereof in the color associated with the second player.

17 Claims, 5 Drawing Sheets

WORD GAME WITH BOARD AND PLAYING PIECES ROTATABLY SUPPORTED THEREIN

BACKGROUND OF THE INVENTION

The present invention relates to parlor games, and, more particularly, to parlor games in which the players attempt to place a number of playing pieces on a playing board to form a cognizable linear array such as words and the like.

Crossword games such as the SCRABBLE brand word game sold by Selchow and Righter Co. have enjoyed considerable success in that a plurality of players can test their ability to devise words from playing pieces which they have drawn and from playing pieces which may already be placed upon the playing board. The player with a good vocabulary and facile ability to conceptualize words utilizing playing pieces upon the board will generally be highly successful in such word games.

Over the past few years there has been an increasing tendency to create games which reward strategy, i.e., in which one player may thwart another player's actions or reduce the effect of those actions. By doing so, the player increases his or her own score.

It is an object of the present invention to provide a novel parlor game which rewards strategy as well as the ability to formulate cognizable arrays of playing pieces such as words and the like.

It is also an object to provide such a game in which the components may be readily and economically fabricated and which will exhibit long life.

Another object is to provide a novel method of game play combining strategy and the ability to formulate words and like cognizable arrays of playing pieces.

SUMMARY OF THE INVENTION

It has now been found that the foregoing and related objects may be readily attained in a board game comprising a playing board having a playing surface with a rectangular grid formed by multiple rows and columns of recesses, and a multiplicity of playing pieces having a body portion and which are dimensioned to seat within the recesses of the playing board. The playing pieces bear repetitions of an indicium about the periphery of the body portion and each of the repetitions is in a distinct color.

In the game play, a player may place a multiplicity of the playing pieces in aligned recesses to construct a cognizable linear array of indicia each displayed in the preselected color associated with that player. A second player is able to place a least one playing piece in an empty recess adjacent one of the recesses utilized by the linear array of the first player to create a new cognizable linear array using at least the indicium of the one recess. The playing pieces added by the second player display the repetition of the indicium of a color associated with the second player, and the playing piece of the first player in the one recess is rotated to display the repetition of the indicium of the color associated with the second player.

Preferably, the body portion of the playing pieces is of substantially cylindrical configuration, and desirably they are of tubular cross section.

In their usual form, the playing pieces have a diameter greater than the depth of the recesses so as to project thereabove to facilitate their rotation while seated in the recesses.

At least 3 repetitions of an indicium are spaced about the periphery of each playing piece, and the indicia comprise letters of the alphabet and the cognizable arrays comprise words.

Preferably, the recesses are of generally rectangular cross section, and the board game additionally includes a multiplicity of racks each with a shelf-like recess for temporarily seating the playing pieces of a player.

DETAILED DESCRIPTION OF THE ILLUSTRATED EMBODIMENT

Figure 1:
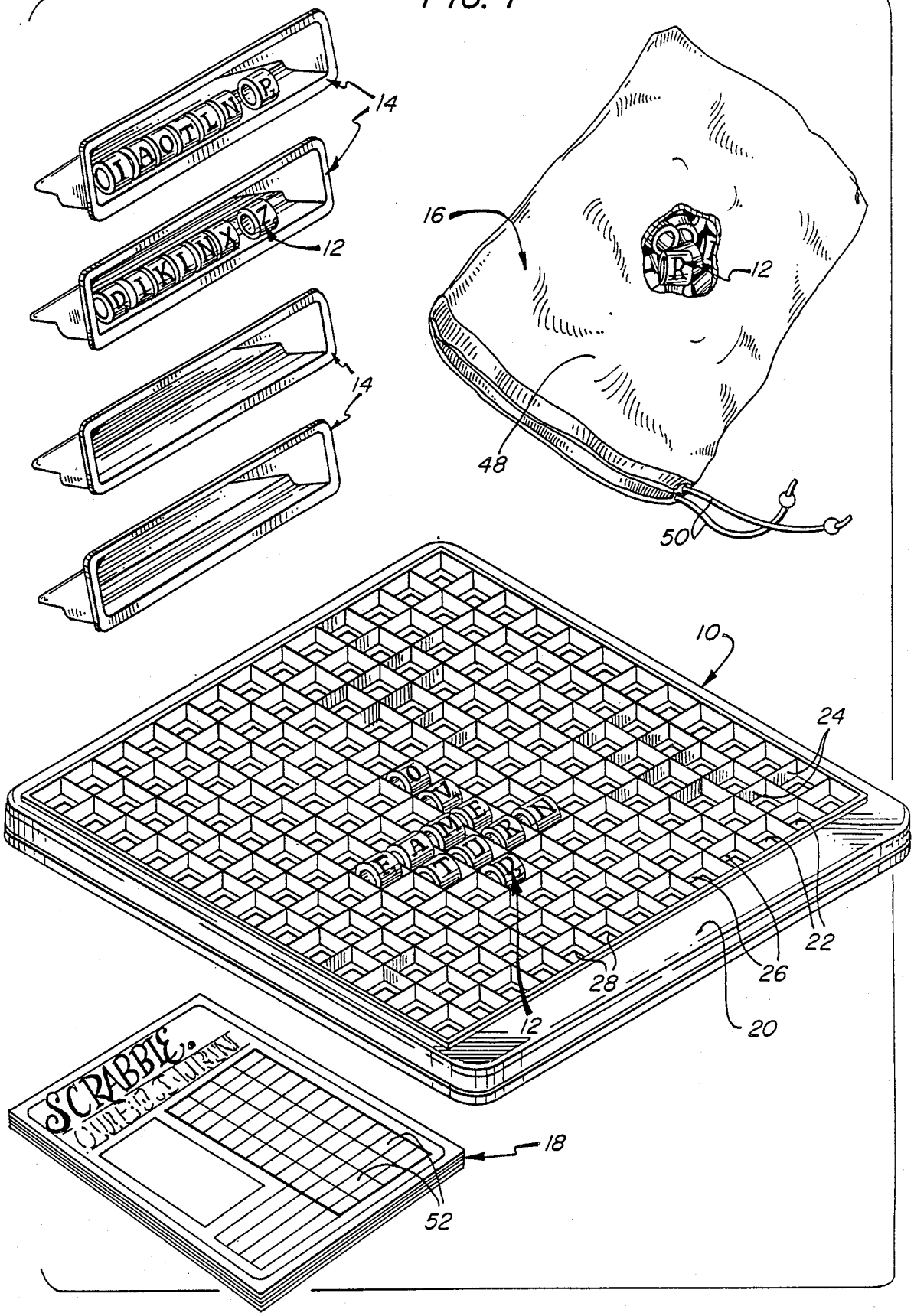
FIG. 1 is a partially exploded view of the components which comprise a parlor game embodying the present invention with a number of playing pieces disposed within recesses of the playing board and with a portion of the pouch broken away to show the playing pieces disposed therewithin.

As seen in FIG. 1, a parlor game embodying the present invention includes a playing board generally designated by the numeral 10, a multiplicity of playing pieces generally designated by the numeral 12, and racks generally designated by the numeral 14 in which the individual players may store the playing pieces 12 which they have drawn. The playing pieces 12 are stored in a pouch generally designated by the numeral 16 and from which the players draw the individual playing pieces. In addition, FIG. 1 illustrates a score pad generally designated by the numeral 18 and upon which the scores of the players are kept during the course of the play action.

Figure 2:
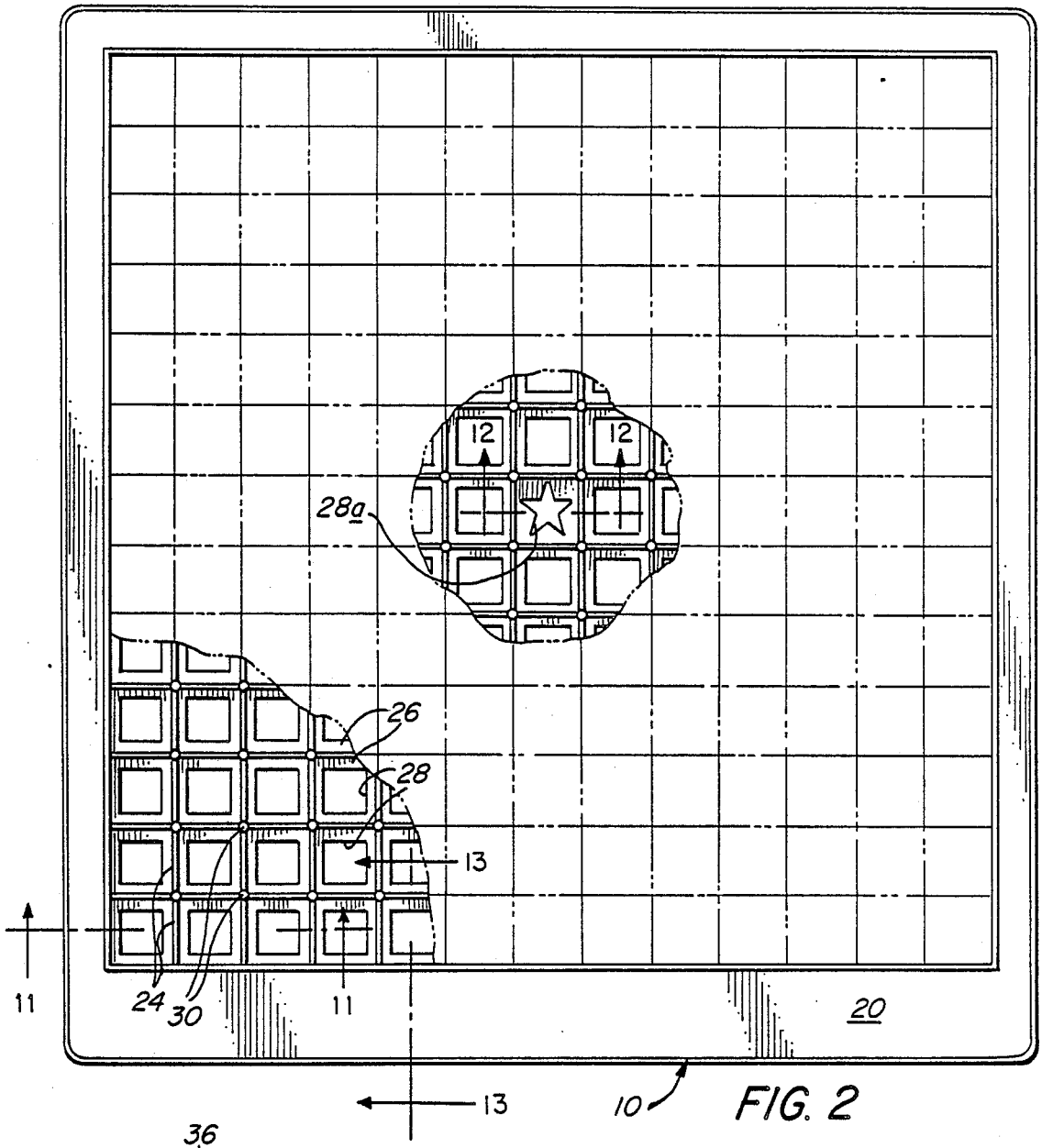
FIG. 2 is a plan view to an enlarged scale of the playing board of FIG. 1.
Figure 3:
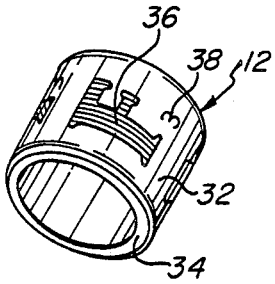
FIG. 3 is a perspective view of a playing piece.
Figure 4:
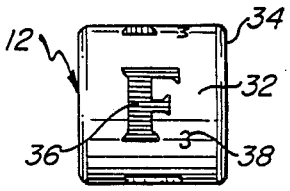
FIG. 4 is a front elevational view thereof with one of the repetitions of the indicium clearly shown.
Figure 5:
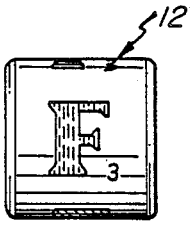
FIG. 5 is a view of the playing piece of FIG. 4 rotated to show the indicium in a different color.
Figure 6:
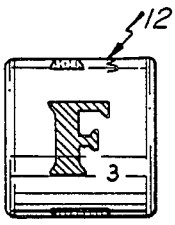
FIG. 6 is a similar view showing the playing piece rotated still further to show the indicium in still another color.
Figure 11:
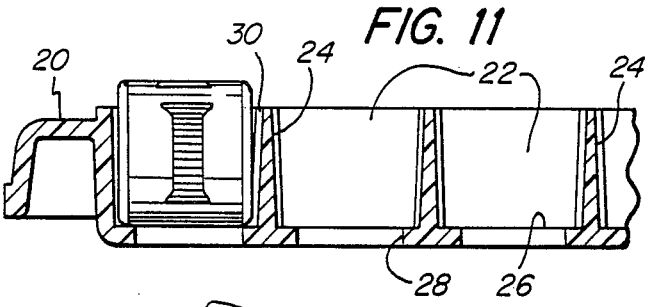
FIG. 11 is a fragmentary sectional view of the board along the line 11—11 of FIG. 2 drawn to a greatly enlarged scale and having a playing piece disposed in the corner recess.
Figure 12:
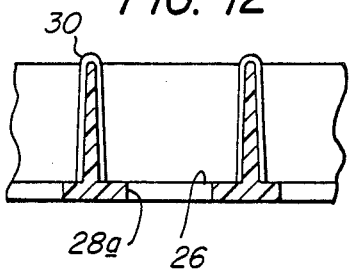
FIG. 12 is a fragmentary sectional view of the board along the line 12—12 of FIG. 2 drawn to a greatly enlarged scale.
Figure 13:
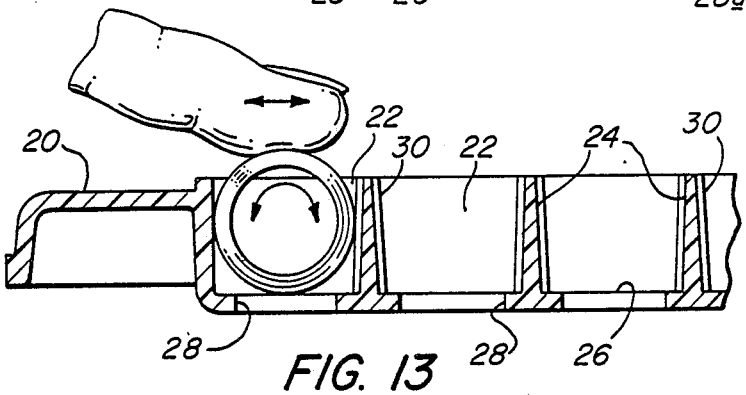
FIG. 13 is a fragmentary sectional view of the board along the line 13—13 of FIG. 2 showing a playing piece disposed in a recess in the outer row and a finger of a user to diagrammatically illustrate rotation of the playing piece within the recess of the playing board.

Turning in detail first to the playing board 10, its structure is best seen in FIGS. 1, 2 and 11–14. The playing board 10 is molded from synthetic resin with a peripheral flange 20 extending thereabout and the body of the board 10 is formed with a multiplicity of recesses 22 arranged in parallel columns and rows. Each of the recesses 22 are defined by the side walls 24 and the base wall 26 which has an aperture 28 therein. The bosses 30 at the corners of the recesses 22 reinforce the side walls 24 at their intersections. As best seen in FIG. 2, the aperture 28*a* in the center recess is formed in the shape of a star. As seen in FIGS. 11–13, the side walls taper in thickness to their upper ends to facilitate the molding operation, and it will be appreciated that the bosses 30 at the corners of the recesses enhance the strength of the assembly.

Turning now in detail to the playing pieces 12, these are of tubular cylindrical configuration with a body portion 32 and chamfered ends 34. Spaced about the periphery of the body portion 32 are a series of four repetitions of a single indicium 36 with each repetition being of a distinct color. Thus, in the illustrated embodiment, each indicium is repeated four times in four different colors. Moreover, in the illustrated embodiment, some of the playing pieces 12 also have thereon a score indicium 38 associated with a particular indicium 36.

Figure 7:
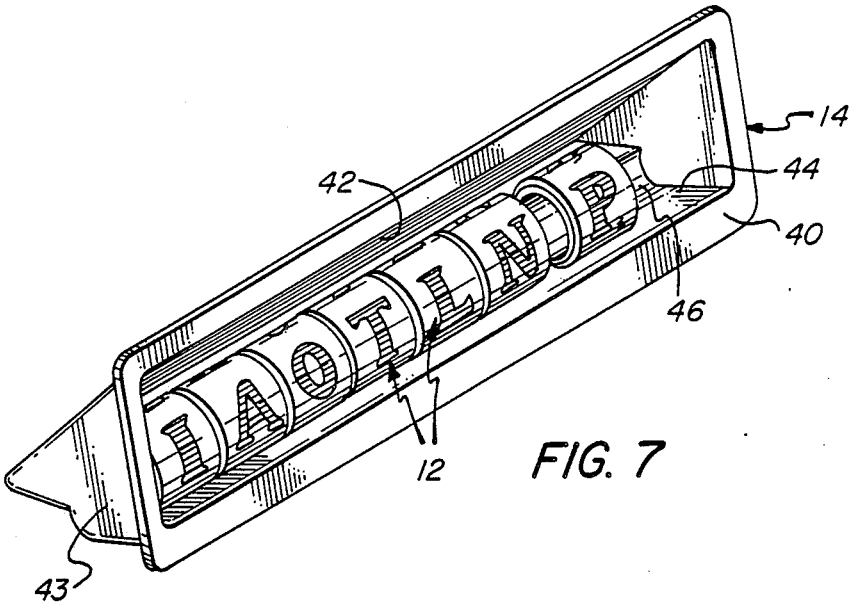
FIG. 7 is a perspective view of a players rack with a number of the playing pieces seated therein.
Figure 8:
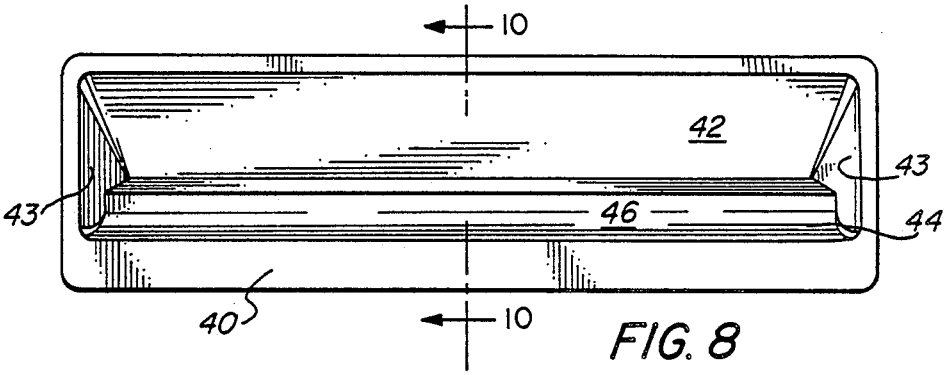
FIG. 8 is a front elevational view of a player's rack.
Figure 9:
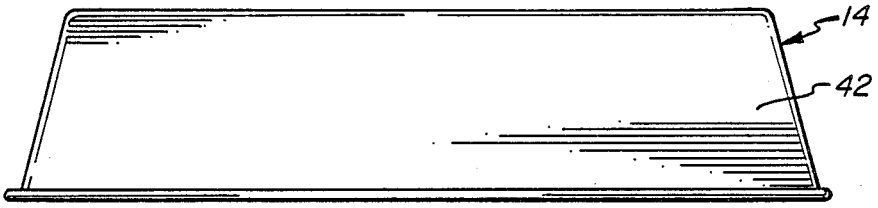
FIG. 9 is a top view thereof.
Figure 10:
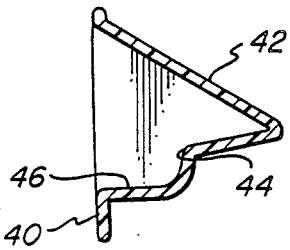
FIG. 10 is a sectional view along the line 10—10 of FIG. 8.

Turning next to the rack 14, this is also a molded structure which is formed with a front wall 40 providing an opening, a sloping wall 42 providing the top and rear of the rack 14, and a base wall 44 which is formed to provide a seating recess 46 adjacent the opening in the front wall 40. As seen in FIGS. 1 and 7, each player stores the playing pieces 12 which he has withdrawn from the pouch 16 in the rack 14 so that they are concealed from opposing players until such time as they are to be placed in recesses upon the playing board 10.

The pouch 16 is conveniently formed from fabric providing a body 48 forming a receptacle for the playing pieces 12, and the open end thereof is closed by the drawstring 50.

Lastly, the game of the present invention conveniently includes a printed score pad 18 with columns 52 which will be assigned to individual players and in which their score is to be recorded during the playing action.

Figure 14:
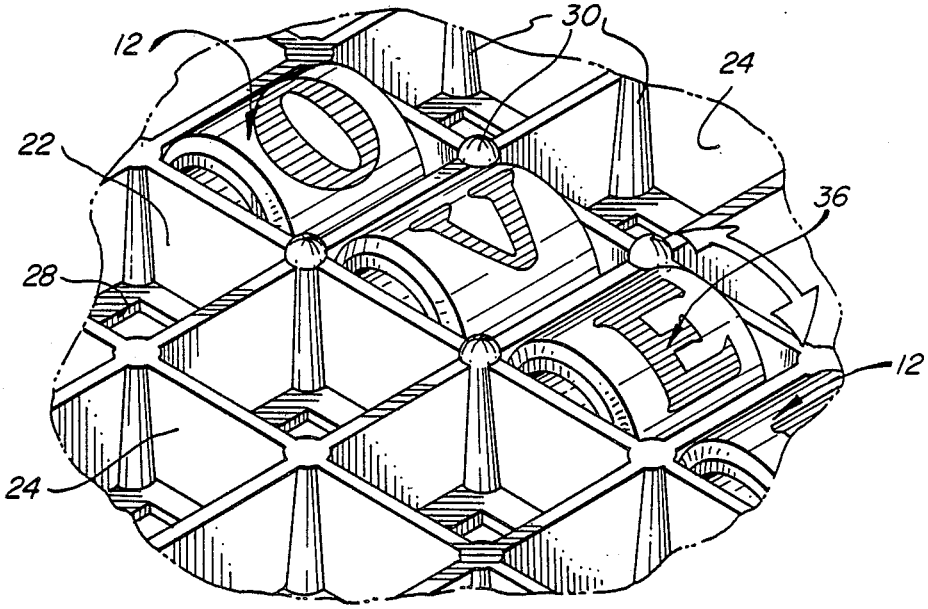
FIG. 14 is a fragmentary perspective view of the board with several playing pieces disposed in recesses thereof.

In FIG. 11, it can be seen that the playing piece 12 seats within the recess 22 with some axial clearance due to the draft provided by the molding operation, and its diameter is greater than the depth of the recess so that it projects thereabove. This enables a player to rotate the playing piece 12 within the recess 22 in either direction, as seen in FIGS. 13 and 14.

Figure 15:
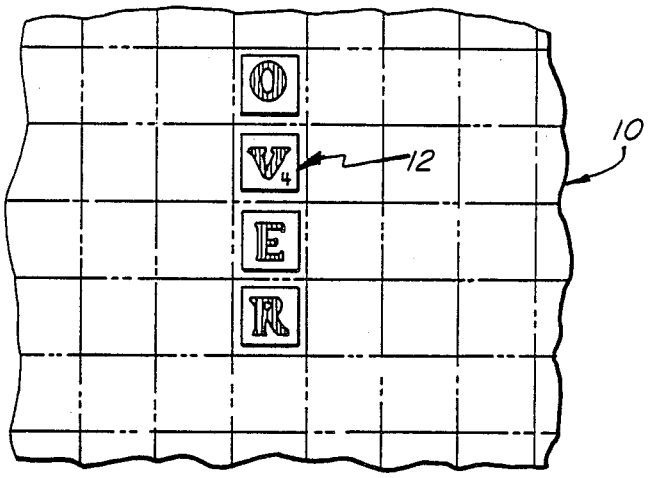
FIG. 15 is a partially diagrammatic view of the playing board with a series of playing pieces placed therein so as to form the word "OVER" in a linear array along a column.
Figure 16:
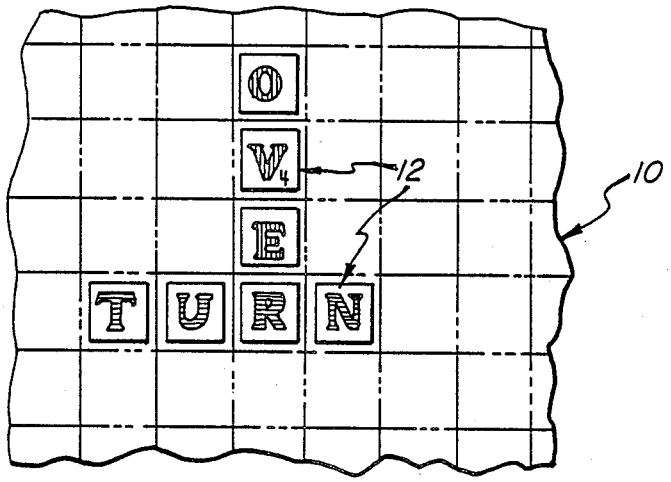
FIG. 16 is a similar illustration showing a second word added onto the word of FIG. 15.
Figure 17:
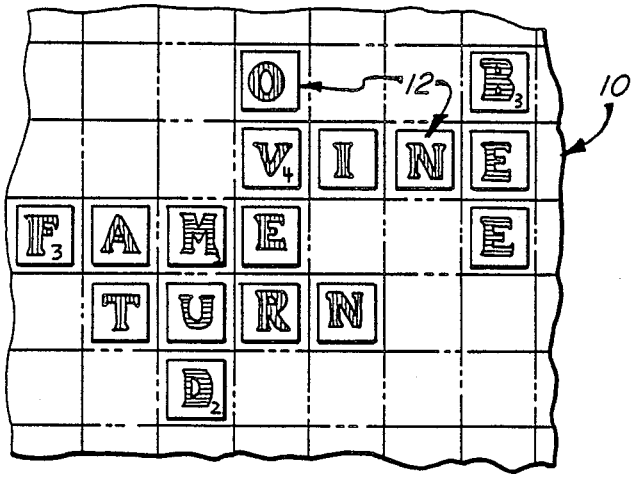
FIG. 17 i a similar view showing further words formed during the course of game action.

In FIGS. 15–17, the game play is schematically illustrated. In FIG. 15, the first player has selected playing pieces 12 with the letters "0", "V", "E" and "R" to form the word "OVER" and placed them in playing board recesses 22 which include the center recess with the star aperture 28*a* in the base wall 26. In this instance, the linear array is in columnar form. The indicia 36 are displayed in the color associated with the first player.

In FIG. 16, the second player has selected the playing pieces 12 with the letters "T", "U" and "N" and placed them in the row of recesses 22 which includes the letter "R" of the first word and thus formed the word "TURN" as a horizontal linear array. The indicia 36 of the added playing pieces are displayed in the color associated with the second player, and the playing piece 12 providing the letter "R" is rotated to display the indicium 36 in the same color. In FIG. 17, there are illustrated further words formed on the board as players add playing pieces and appropriate letters from words previously formed.

As indicated by the caption on the score pad !8, the illustrated embodiment is a variation on the SCRABBLE brand word game so that the indicia on the playing pieces comprise letters and the cognizable linear arrays comprise words. As in the SCRABBLE game, the individual letters utilized in a word have a score associated therewith, and the scores for those letters which are more difficult to utilize are of higher numeric value.

In the present game, there is an element of strategy which is added to the play of the SCRABBLE game which involves "appropriating" letters previously used by another player in forming a word, and thus spoiling other players' ability to use the score for all or a part of a word which they have created. At the end of game play, the players total the score of words which are solely in the color associated with them. Thus, a player can win by appropriating or spoiling words created by his opponent.

In actual game play, all of the letter cylinders are placed in the pouch and thoroughly agitated. Each player takes a letter rack, and draws one playing piece from the pouch. Whoever draws the letter closest to the beginning of the alphabet is the first to play. The letters which were initially drawn to determine the first to play are returned to the pouch and the collection is reagitated.

Each player then selects a color, and the first player draws seven fresh playing pieces and places them upon his or her rack. The other players in turn each take seven playing pieces and place them upon their racks.

The first player then combines two or more letters to form a linear array comprising a word, either horizontally or vertically, but encompassing the center recess (with the star 28*a*). The playing pieces are placed in the recesses so that they display the indicia thereon in the color associated with the first player. The player calculates the score for the word which has been formed by adding the letter values.

In a preferred version of the game rules, the players only record the word score if it reaches a bonus level. If the total is twelve points or more, the player receives a bonus score equal to the value of the word formed, and this is recorded on the score sheet. If the score total for the letters of the word which has been formed is less than twelve points, the player receives no score at this time. After forming the word, the player draws as many new playing pieces as have been played. If a player is able to utilize all seven playing pieces on a single turn, he or she receives a bonus score of twenty-five points and can also receive the bonus for the word if the total score of the letters is twelve points or more.

The next player places one or more letters in recesses adjacent to the linear array or word which has already been formed so that a new word is formed. This will usually involve a linear array which is perpendicular to another word, but letters may be added to an existing word to expand its length. The added playing pieces must all be added in one row or column to form a complete word, and they must form complete words with the letters of any other words which they cross or abut. The player who is forming the new word or words will rotate any playing pieces of words previously formed which are incorporated in his or her word or words to reflect the color associated with him or her. The numeric value of the word or words created by the second player is then determined, and a bonus will be received if the total value is twelve points or more.

The game ends when all playing pieces have been drawn from the pouch and one of the players has used all of his or her playing pieces, or until all possible plays have been made. The players then add up the total letter value of all the words on the board which are exclusively in their own color. Any single word which appears in more than one color may not be claimed by any player. However, if a word which has been broken by playing pieces of different colors does contain one or more short words of a single color, these short words may be scored. For example, "forewarn" with all the letters except for the "e" being in a single player's color would permit that player to score the value of the words "for" and "warn".

Each player's score is reduced by the sum of his or her unplayed letters. If one of the players has used all of his or her letters, this player may add the sum of the other players' unplayed letters to his or her score. The player with the highest total when all scores are computed is the winner.

In the illustrated embodiment, a word game is being played. However, the indicia may comprise numbers and arithematic signs so that the linear arrays would comprise numeric equations. Combinations of numbers and letters may also be employed to produce algabraic expressions; and symbols may be combined in linear arrays.

The board is conveniently formed by injection or compression molding from synthetic resin. However, sheet material could be thermoformed to provide the recesses to seat the playing pieces. The racks are conveniently molded from synthetic resin and the desired configuration may vary appropriately.

In the illustrated embodiment, the playing pieces comprise tubular cylindrical elements so that they may be readily rotated within the playing board recesses. However, the cross section may also be polygonal with the several faces of the polygon comprising the surfaces upon which the indicia are formed. They may also be solid rather than hollow, albeit at greater cost.

Thus, it can be seen from the foregoing detailed specification and claims that the game of the present invention is one which affords a high degree of player interaction and rewards strategy during the play action, as well as the ability to conceptualize linear arrays such as words and equations. The elements of the game may be readily and economically fabricated from materials which will provide a high degree of durability.

Having thus described the invention, what is claimed is:

1. A board game comprising:

(a) a playing board having a playing surface with a rectangular grid formed by multiple rows and columns of recesses; and (b) a multiplicity of playing pieces having a body portion and dimensioned to be removably seated within said recesses of said playing board, each of said playing pieces bearing repetitions of an indicium about the periphery of said body portion, each of said repetitions being in a distinct color, whereby a first player may place a multiplicity of said playing pieces in aligned recesses to construct a cognizable linear array of indicia each displaying a preselected color associated with that player, and a second player may place at least one playing piece on the board in an empty recess adjacent one of said recesses utilized by the linear array of the first player to create a new cognizable linear array incorporating at least the indicium of said at least one recess, said at least one playing piece added by the second player being seated in said adjacent recess displaying the repetition of the indicium in a color associated with the second player and said playing piece of the first player in said one recess being rotatable to display the repetition of the indicium of the color associated with the second player.

2. The board game of claim 1 wherein the body portion of said playing pieces is of substantially cylindrical configuration.

3. The board game of claim 2 wherein said playing pieces are of tubular cross section.

4. The board game of claim 2 wherein said playing pieces have a diameter greater than the depth of said recesses so as to project thereabove to facilitate their rotation while seated in said recesses.

5. The board game of claim 1 wherein there are at least 3 distinctly colored repetitions of an indicium about the periphery of each playing piece.

6. The board game of claim 1 wherein said indicia comprise letters of an alphabet and said cognizable arrays comprise words.

7. The board game of claim 1 wherein said recesses are of generally rectangular cross section.

8. The board game of claim 1 additionally including a multiplicity of racks, each with a shelf-like recess for temporarily seating the playing pieces of a player.

9. A board game comprising:

(a) a playing board having a playing surface with a rectangular grid formed by multiple rows and columns of recesses; and (b) a multiplicity of playing pieces having a substantially cylindrical body portion and dimensioned to be removably seated within said recesses of said playing board, each of said playing pieces bearing at least 3 repetitions of a letter of the alphabet about the periphery of said body portion, each of said repetitions being in a distinct color, said playing pieces having a diameter greater than the depth of said recesses so as to project thereabove to facilitate their rotation while seated in said recesses, whereby a first player may place a multiplicity of said playing pieces in aligned recesses to construct a cognizable linear array of indicia providing a word and each displaying a preselected color associated with that player, and a second player may place at least one playing piece on the board in an empty recess adjacent one of said recesses utilized by the linear array of the first player to create a new cognizable linear array comprising another word incorporating at least the indicium of said at least one recess, said at least one playing piece added by the second player being seated in said adjacent recess displaying the repetition of the indicium in a color associated with the second player and said playing piece of the first player in said one recess being rotatable to display the repetition of the indicium of the color associated with the second player.

10. The board game of claim 9 wherein said playing pieces are of tubular cross section.

11. The board game of claim 9 wherein said recesses are of generally rectangular cross section.

12. The board game of claim 9 additionally including a multiplicity of racks each with a shelf-like recess for temporarily seating the playing pieces of a player.

13. In a method of playing a board game, the steps comprising:

(a) providing a playing board having a playing surface with a rectangular grid formed by multiple rows and columns of recesses;

(b) providing to each of a multiplicity of players a multiplicity of playing pieces each having a body portion and dimensioned to seat within said recesses of said playing board, said playing pieces bearing repetitions of an indicium about the periphery of said body portion, each of said repetitions being in a distinct color;

(c) a first player placing a multiplicity of said playing pieces in aligned recesses to construct a cognizable linear array of indicia each displaying a preselected color associated with that player; and (d) a second player placing at least one playing piece in an empty recess adjacent one of said recesses utilized by said linear array of said first player to create a new cognizable linear array incorporating in said array at least the indicium of said at least one recess, said at least one playing piece added by the second player being seated in said adjacent recess and displaying the repetition of the indicium in a color associated with the second player and said playing piece of the first player being rotated in said one recess to display the repetition of the indicium of the color associated with the second player.

14. The method of playing a board game of claim 13 wherein the body portion of said playing pieces is of substantially cylindrical configuration.

15. The method of playing a board game of claim 13 wherein said playing pieces have a diameter greater than the depth of said recesses so as to project thereabove to facilitate their rotation while seated in said recesses.

16. The method of playing a board game of claim 13 wherein said indicia comprise letters of the alphabet and said cognizable arrays comprise words.

17. The method of playing a board game of claim 13 additionally including the step of providing each player a rack with a shelf-like recess for temporarily seating the playing pieces of a player, and wherein said playing pieces are drawn from a large collection by the players and temporarily stored by the players on their racks, and wherein said playing pieces are drawn from said racks by said players for placement in said recesses of said board.

* * * * *